US006426626B1

(12) United States Patent
Kravis

(10) Patent No.: US 6,426,626 B1
(45) Date of Patent: Jul. 30, 2002

(54) APPARATUS AND METHOD FOR TESTING AN IGNITION COIL AND SPARK PLUG

(75) Inventor: Steven F. Kravis, Farmington Hills, MI (US)

(73) Assignee: Progressive Tool & Industries Company, Southfield, MI (US)

( * ) Notice: Subject to any disclaimer, the term of this patent is extended or adjusted under 35 U.S.C. 154(b) by 0 days.

(21) Appl. No.: 09/280,276

(22) Filed: Mar. 29, 1999

Related U.S. Application Data

(60) Provisional application No. 60/080,221, filed on Mar. 31, 1998.

(51) Int. Cl.[7] ..... F02P 17/00

(52) U.S. Cl. ..... 324/388; 324/378; 324/379; 324/393

(58) Field of Search ..... 324/379, 378, 324/388, 380, 389, 393, 402, 686, 399; 73/117.3; 123/481, 478, 406.14

(56) References Cited

U.S. PATENT DOCUMENTS

| | | | | | |
|---|---|---|---|---|---|
| 4,032,842 | A | | 6/1977 | Green et al. | |
| 4,156,839 | A | | 5/1979 | Nakagawa | |
| 4,267,569 | A | * | 5/1981 | Baumann | 73/116 |
| 4,291,383 | A | | 9/1981 | Tedeschi et al. | |
| 4,746,868 | A | | 5/1988 | Davis | |
| 4,825,167 | A | | 4/1989 | Bayba | |
| 5,068,613 | A | * | 11/1991 | Kreft | 324/379 |
| 5,111,790 | A | * | 5/1992 | Grandy | 123/406.14 |
| 5,160,892 | A | * | 11/1992 | Makhija | 324/379 |
| 5,250,935 | A | * | 10/1993 | Jonker | 702/67 |
| 5,387,870 | A | * | 2/1995 | Knapp | 324/379 |
| 5,426,369 | A | | 6/1995 | Brinker | |
| 5,507,264 | A | * | 4/1996 | Kugler et al. | 123/481 |
| 5,523,691 | A | | 6/1996 | Frus | |
| 5,550,737 | A | | 8/1996 | Tedeschi | |
| 5,675,257 | A | | 10/1997 | Frus | |
| 5,687,082 | A | | 11/1997 | Rizzoni | |
| 5,714,679 | A | | 2/1998 | Nichols et al. | |
| 5,811,670 | A | | 9/1998 | Nolte et al. | |
| 5,821,754 | A | * | 10/1998 | Puettmann et al. | 324/388 |
| 6,188,224 | B1 | * | 2/2001 | Hannoyer et al. | 324/380 |

* cited by examiner

*Primary Examiner*—N. Le
*Assistant Examiner*—Anjan K Deb
(74) *Attorney, Agent, or Firm*—Young & Basile, P.C.

(57) ABSTRACT

A method and apparatus for testing spark plugs and ignition coils. An apparatus includes a power supply for supplying power to an ignition coil to generate a spark across a spark plug. A capture circuit captures an energy signal reflected from the ignition coil in response to the spark. A comparator circuit compares the captured energy signal to a predetermined signal. A method includes the steps of supplying power to an ignition coil to generate a spark across a spark plug, capturing an energy signal reflected from the ignition coil in response to the spark and comparing the captured energy signal to a predetermined signal. The predetermined signal represents one of a distinct group of reflected energy signals which indicate various defects in the coil or plug. Preferably, a match between the captured energy signal and the predetermined signal is used to indicate to the user a defective coil or plug.

32 Claims, 6 Drawing Sheets

APPARATUS AND METHOD FOR TESTING AN IGNITION COIL AND SPARK PLUG

RELATED APPLICATIONS

This application claims the benefit of U.S. Provisional Application No. 60/080,221, filed Mar. 31, 1998.

FIELD OF THE INVENTION

The subject invention relates to an apparatus and method for testing an ignition coil and a spark plug and, more particularly, to an apparatus and method capable of identifying defects in an ignition coil and a spark plug connected in a "coil on plug" design.

BACKGROUND OF THE INVENTION

Most conventional spark-ignition engines include a single ignition coil wired to several spark plugs for initiating fuel combustion in each engine cylinder. To ensure quality, these engines are typically cold motor tested for defects prior to shipment to a vehicle assembly plant. During the cold motor testing, each engine is mechanically cranked by an external testing mechanism through at least one complete engine cycle. Thus, there is no combustion of fuel during the cold motor testing.

To detect ignition coil and spark plug defects, conventional engine testing methods have monitored an electrical signal transmitted from a secondary side of the ignition coil to each spark plug during each spark generation. However, the recent development of a new ignition coil and spark plug packaging arrangement, commonly referred to as a "coil on plug" design, has rendered such prior art testing methods obsolete.

Unlike conventional designs, the "coil on plug" arrangement provides one ignition coil and one spark plug for each engine cylinder. The "coil on plug" design additionally includes a boot or sleeve which extends from the secondary side of the ignition coil to the middle of the spark plug. Thus, the boot insulates the entire length of an electrical transmission wire connected between the ignition coil and the spark plug. As a result, access to the aforementioned electrical signal is not available in the "coil on plug" design. Accordingly, it would be desirable to provide an apparatus and method for testing an ignition coil and a spark plug connected in a "coil on plug" design.

SUMMARY OF THE INVENTION

In a disclosed embodiment of this invention, an apparatus tests an ignition coil and a spark plug for defects. The apparatus includes a power supply for supplying power to the ignition coil to generate a spark across the spark plug. A capture circuit captures an energy signal reflected from the ignition coil in response to the spark generation. A comparator circuit compares the captured energy signal to a predetermined signal.

The ignition coil includes a first winding in electrical communication with the power supply and a second winding in electrical communication with the spark plug. Accordingly, the energy signal is reflected from the first winding of the ignition coil in response to the spark generation.

The predetermined signal represents one of a group of distinct reflected energy signals which indicate various defects in an ignition coil or spark plug. In a preferred embodiment, the comparator circuit generates an output in response to a match between the captured energy signal and the predetermined signal to indicate a defective ignition coil or spark plug.

The present invention also provides a method for testing an ignition coil and a spark plug for defects. The method includes the steps of: supplying power to the ignition coil to generate a spark across the spark plug; capturing an energy signal reflected from the ignition coil in response to the spark generation; and comparing the captured energy signal to a predetermined signal. Preferably, the method further includes the step of generating an output in response to a match between the captured energy signal and the predetermined signal to indicate a defective ignition coil or spark plug.

The present invention provides an apparatus and method capable of testing an ignition coil and a spark plug connected in a "coil on plug" design for various types of defects. The present invention is also capable of disclosing which specific type of defect was detected.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
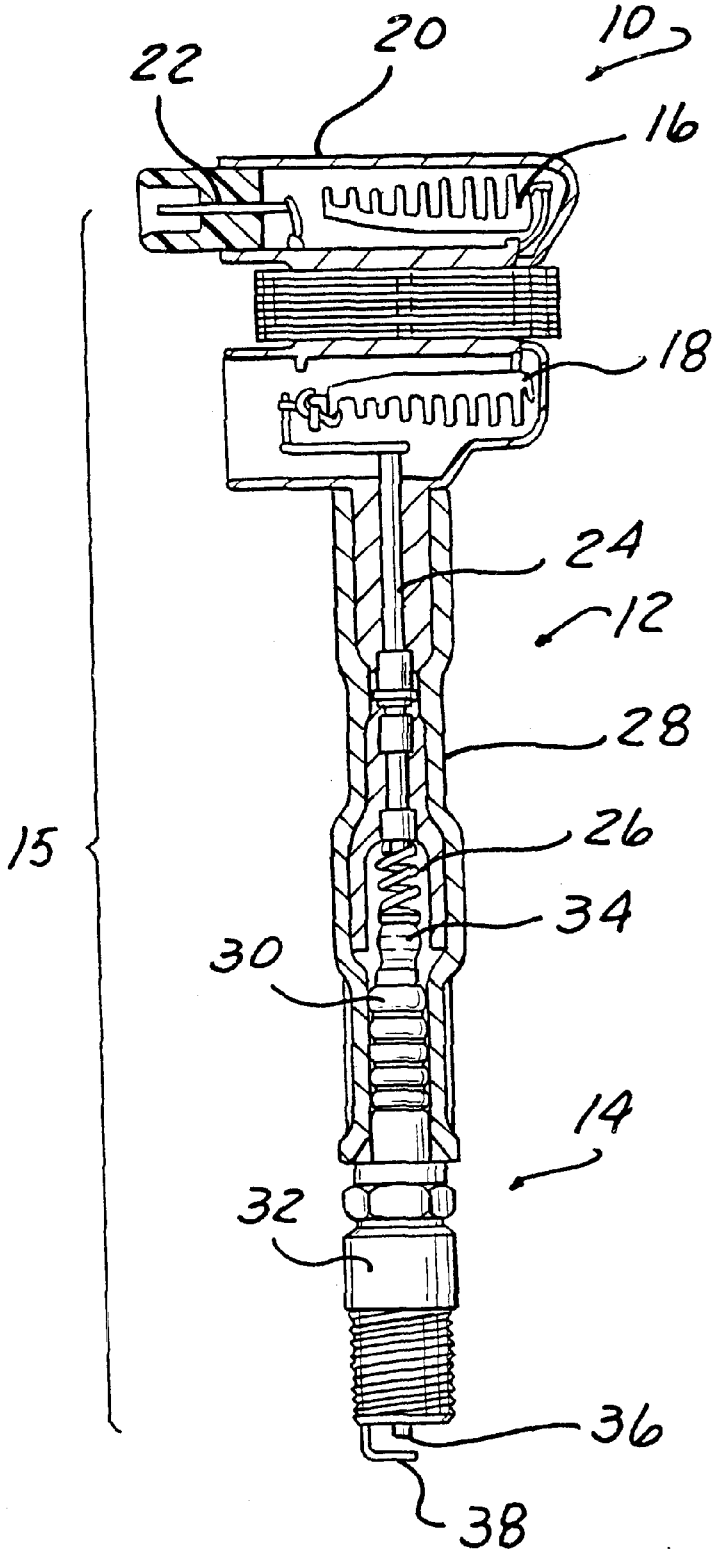
FIG. 1 is a cross-sectional view of an ignition coil, an insulation boot assembly, and a spark plug connected in a "coil on plug" design.

Referring now to the Figures, wherein like numerals indicate like or corresponding parts throughout the several views, FIG. 1 shows a cross-sectional view of an ignition coil 10, an insulation boot assembly 12, and a spark plug 14 connected in an arrangement commonly referred to as a "coil on plug" design. The term "coil on plug" describes a design in which one ignition coil and one spark plug are provided for each cylinder of a spark-ignition engine. When assembled, the ignition coil 10, the insulation boot assembly 12, and the spark plug 14 form a "coil on plug" assembly 15.

The ignition coil 10 functions as both an energy-storage device and a transformer. The ignition coil 10 includes a first electrical winding 16 and a second electrical winding 18 disposed within a housing 20. In FIG. 1, the cross-sectional view of the ignition coil 10 reveals the first and second windings 16 and 18 within the housing 20. The first winding 16 is in electrical communication with a low-voltage terminal 22. The low-voltage terminal 22 is adapted to receive power from a remote power supply. The second winding 18 is in electrical communication, via the insulation boot assembly 12, with the spark plug 14. The ignition coil 10 is adapted to receive a supply voltage from the remote power supply, transform the supply voltage to a higher ignition voltage, and transmit the ignition voltage to the spark plug 14 at a predetermined time. The ignition voltage is transmitted from the second winding 18 of the ignition coil 10 to the spark plug 14 through the insulation boot assembly 12.

To transmit the ignition voltage, the insulation boot assembly 12 includes a transmission wire 24 and a contact spring 26 disposed within an insulation sleeve 28. In FIG. 1, the cross-sectional view the insulation boot assembly 12 reveals the transmission wire 24 and the contact spring 26 surrounded by the insulation sleeve 28. Typically, the insulation sleeve 28 is made from a flexible rubber material. When the insulation boot assembly 12 is properly inserted onto the spark plug 14, the contact spring 26 compresses to provide an electrical connection between the transmission wire 24 and the spark plug 14 and the insulation sleeve 28 covers an upper body portion 30 of the spark plug 14.

The upper body portion 30 of the spark plug 14 is commonly referred to as the insulator. A lower body portion 32 of the spark plug 14 is commonly referred to as the shell. Typically, the insulator 30 is made from a ceramic material and the shell 32 is made from a metal material. A high voltage connector 34 is disposed at the distal end of the insulator 30. A pair of spaced electrodes 36 and 38 are disposed at the opposing end of the spark plug 14. The high voltage connector 34 is shaped to form an electrical connection with the contact spring 26 within the insulation boot assembly 12. The electrodes 36 and 38 are specifically gaped or spaced so as to produce an electrical arc when the ignition voltage is supplied to the spark plug 14.

Figure 2:
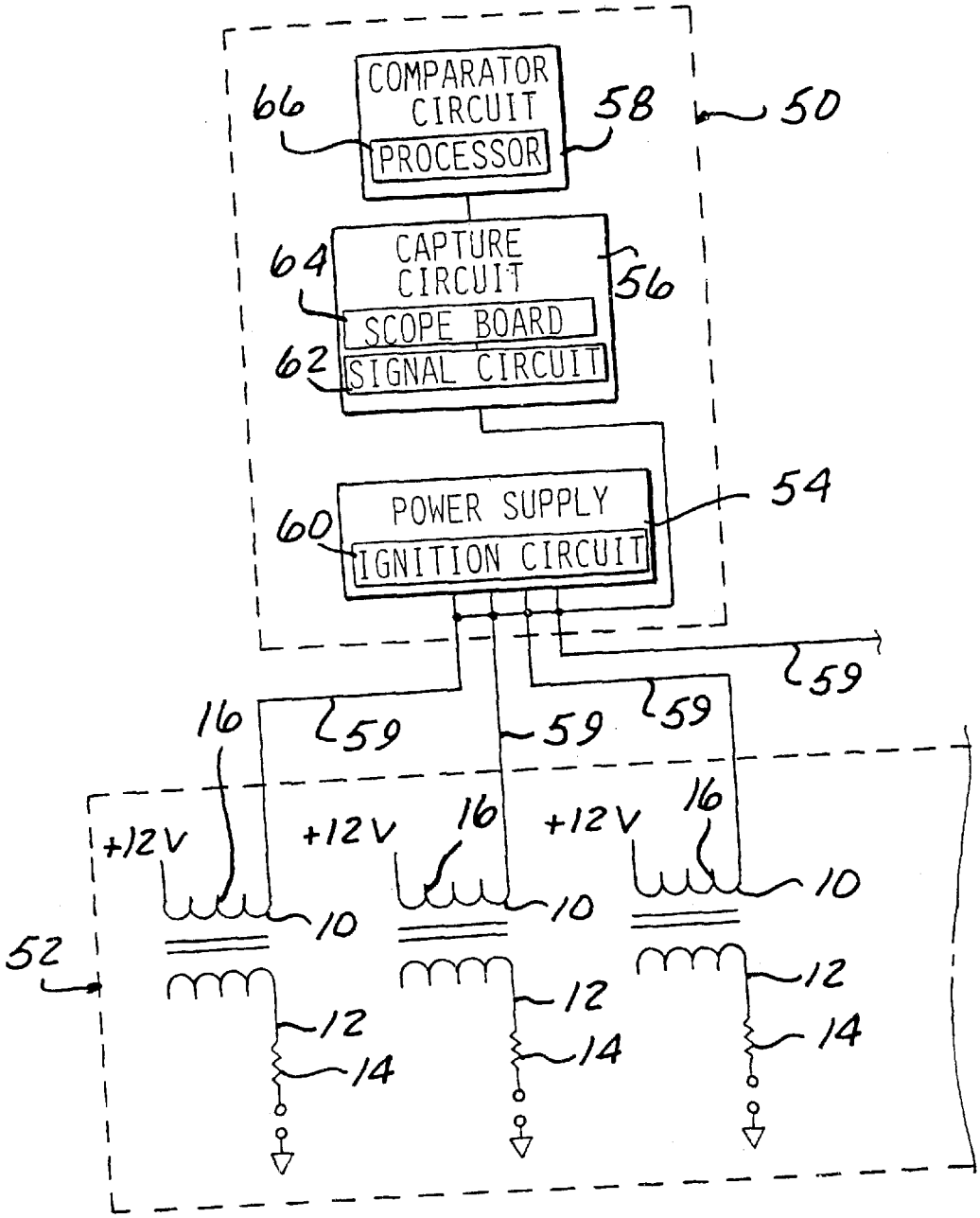
FIG. 2 an electrical schematic diagram of an apparatus, in accordance with the present invention, connected to an engine having at least one ignition coil and spark plug installed in a "coil on plug" design.

FIG. 2 is an electrical schematic diagram of an apparatus 50, in accordance with the present invention, connected to an engine 52 having at least one ignition coil 10 and spark plug 14 installed in a "coil on plug" design. The apparatus 50 is designed primarily to test for defects in a "coil on plug" assembly. Further, the present invention is suited to detect such defects in an engine having a separate ignition coil, insulation boot assembly, and spark plug for each cylinder. Accordingly, the engine 52 partially illustrated in FIG. 2 has a separate ignition coil 10, insulation boot assembly 12, and spark plug 14 for each cylinder.

The apparatus 50 includes a power supply 54 for supplying power to the ignition coil 10 to generate a spark across the spark plug 14. A capture circuit 56 captures an energy signal reflected from the ignition coil 10 in response to the spark generation. A comparator circuit 58 compares the captured energy signal to a predetermined signal. Preferably, the comparator circuit 58 also generates an output in response to a match between the captured energy signal and the predetermined signal.

As shown in FIG. 2, the first winding 16 of the ignition coil 10 is in electrical communication, via a supply voltage wire 59, with the power supply 54 and the second winding 18 of the ignition coil 10 is in electrical communication, via the insulation boot assembly 12, with the spark plug 14. Accordingly, the energy signal is reflected from the first winding 16 of the ignition coil 10 in response to the spark generation. Preferably, the reflected energy signal is a voltage waveform signal. As illustrated in FIG. 2, each ignition coil 10 within the engine 52 is electrically connected to the power supply 54 via a separate supply voltage wire 59. In this manner, the power supply 54 is capable of supplying power to each ignition coil 10 within the engine 52 in a predetermined cycle.

The predetermined signal may be selected from one of a distinct group of reflected energy signals that indicate a defective ignition coil, a defective insulation boot assembly, a defective spark plug or a misrouted supply voltage wire. Specifically, the predetermined signal may be selected to identify the following defects: an electrically open ignition coil; an insulation boot assembly having an electrically open contact spring; a spark plug having a cracked insulator; a spark plug having an electrically shorted pair of electrodes; a spark plug having an electrode gap approximately equal to or less than 0.050 inches; an electrically open spark plug; and an ignition coil connected to a misrouted supply voltage wire. A misrouted supply voltage wire includes a pair of ignition coils connected to a pair of crossed or swapped supply voltage wires. Alternatively, the predetermined signal may be selected to represent a reflected energy signal produced by a properly wired, non-defective "coil on plug" assembly.

Figure 3A:
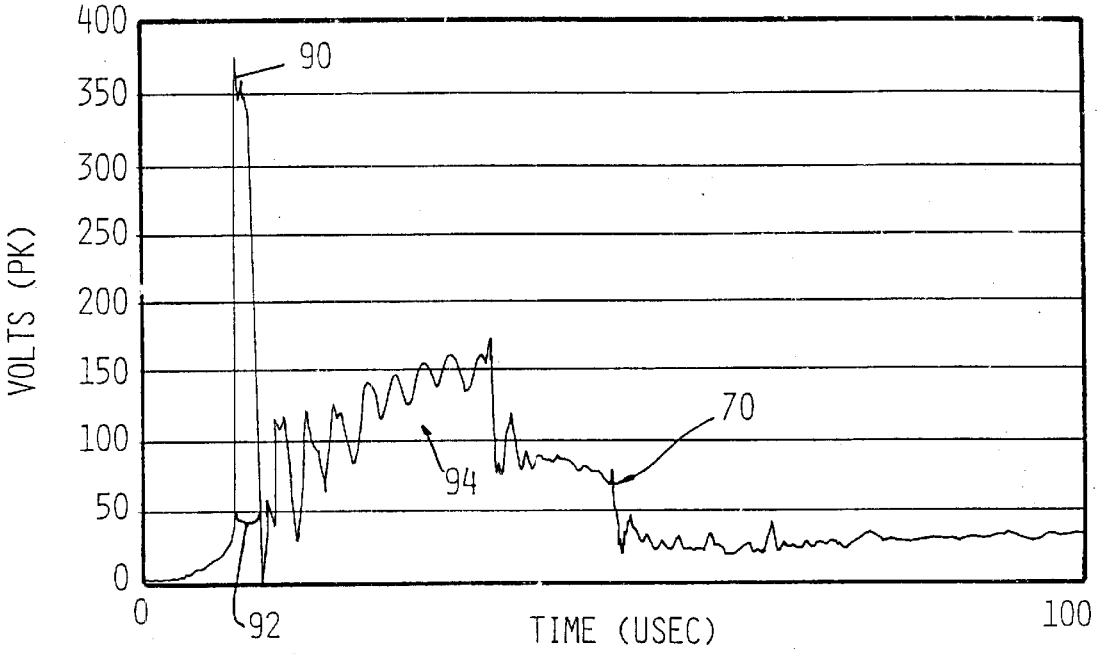
FIG. 3A is a graph illustrating a reflected energy signal produced by a properly wired, non-defective "coil on plug" assembly.
Figure 3B:
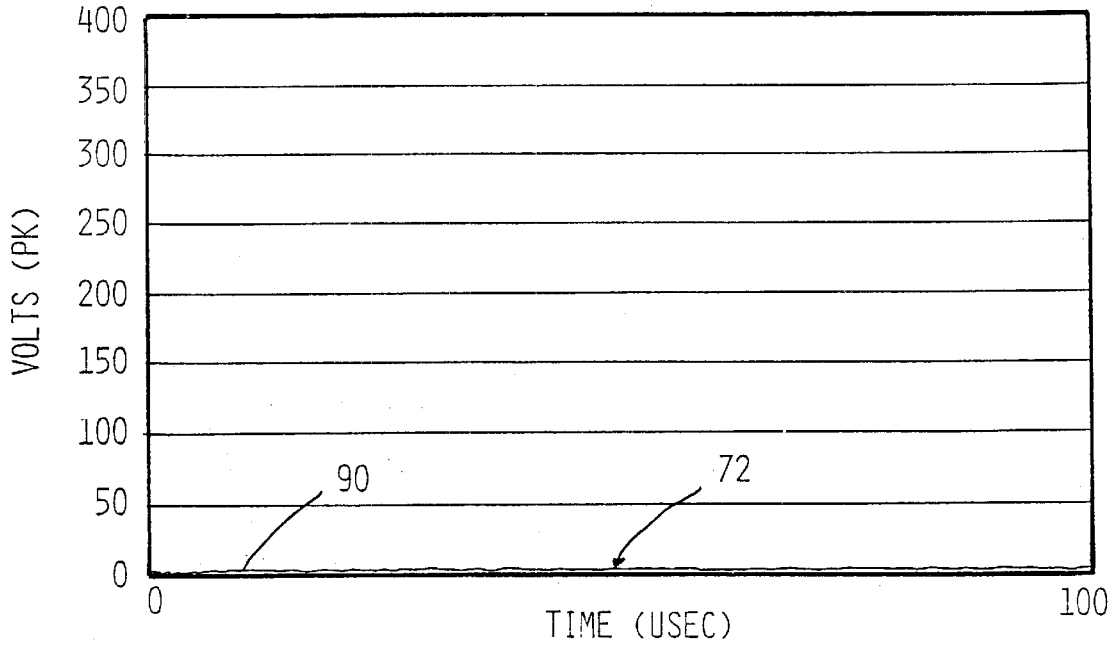
FIG. 3B is a graph illustrating a reflected energy signal produced by an electrically open ignition coil.
Figure 3C:
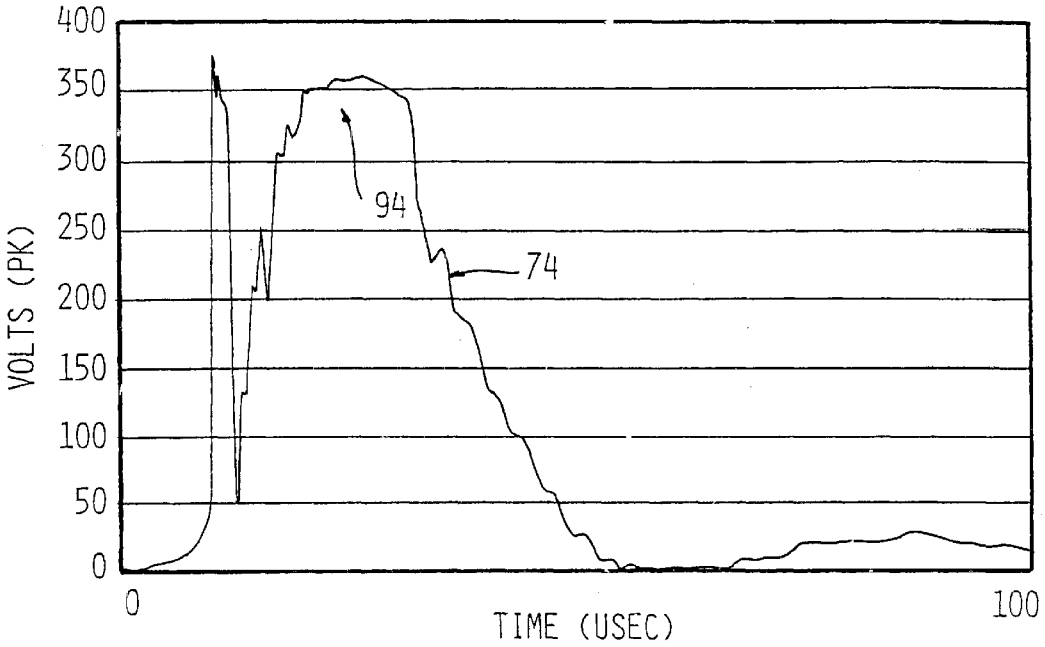
FIG. 3C is a graph illustrating a reflected energy signal produced by an insulation boot assembly having an electrically open contact spring.
Figure 3D:
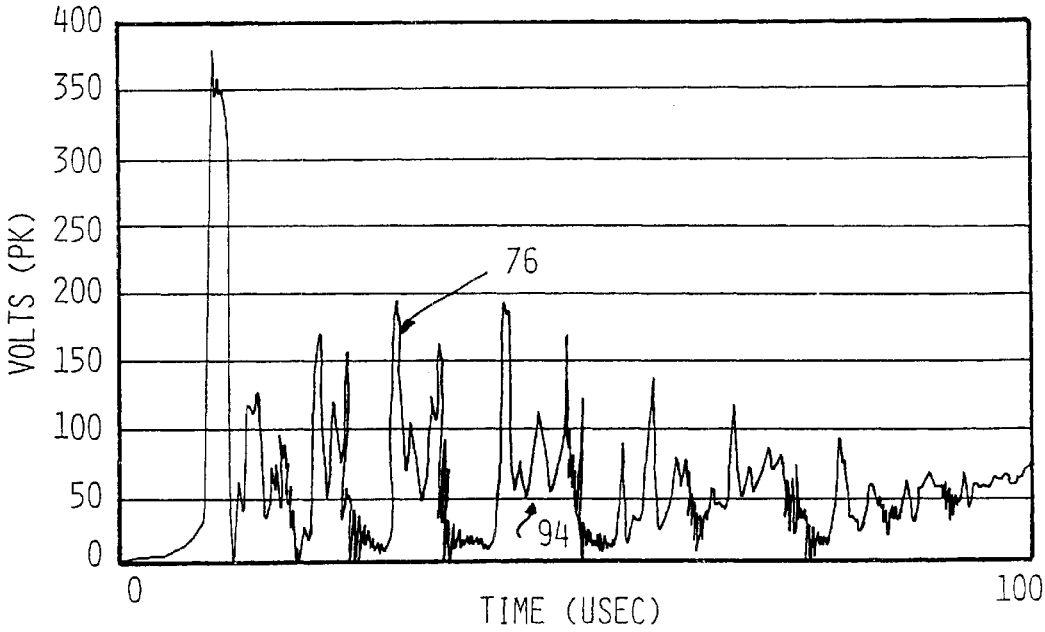
FIG. 3D is a graph illustrating a reflected energy signal produced by a spark plug having a cracked insulator.
Figure 3E:
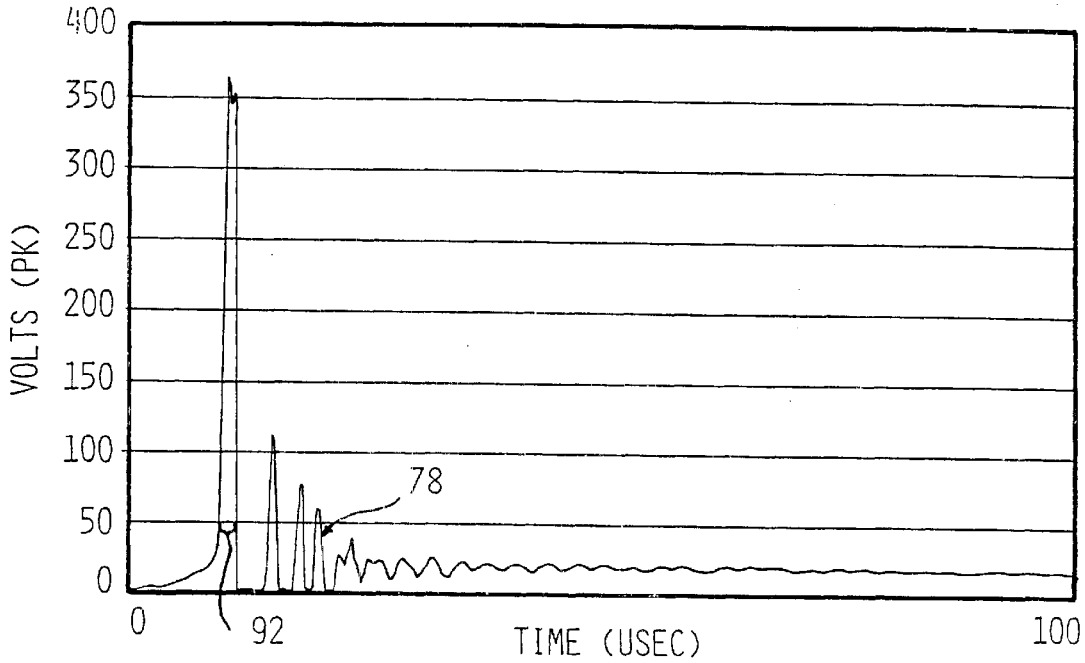
FIG. 3E is a graph illustrating a reflected energy signal produced by a spark plug having a electrically shorted pair of electrodes.
Figure 3F:
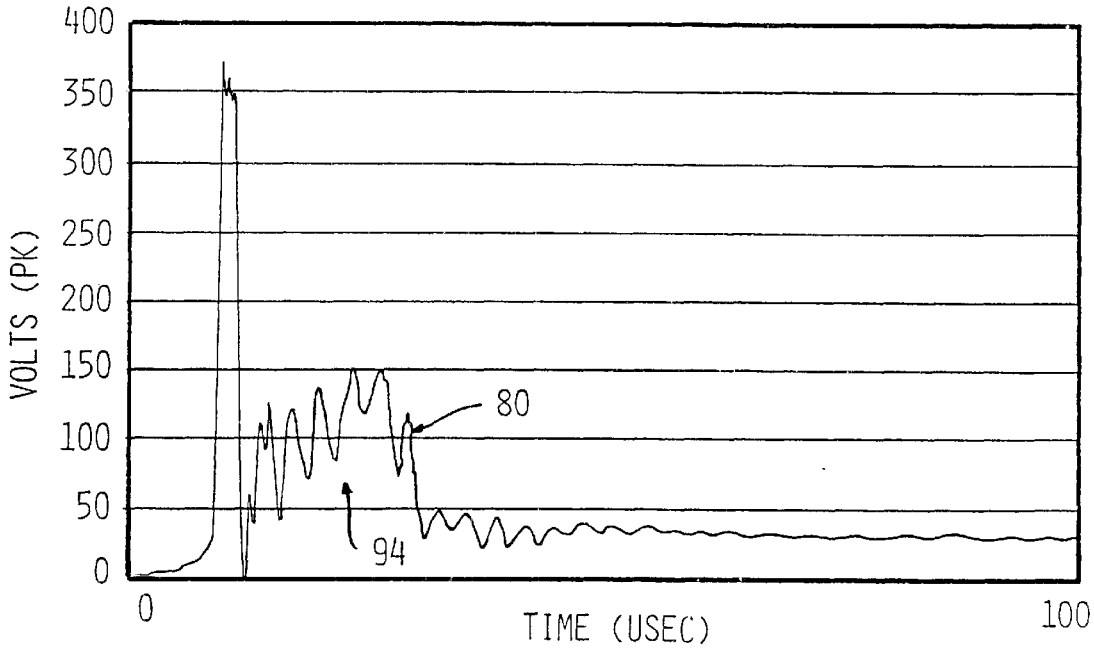
FIG. 3F is a graph illustrating a reflected energy signal produced by a spark plug having an electrode gap approximately equal to or less than 0.050 inches.
Figure 3G:
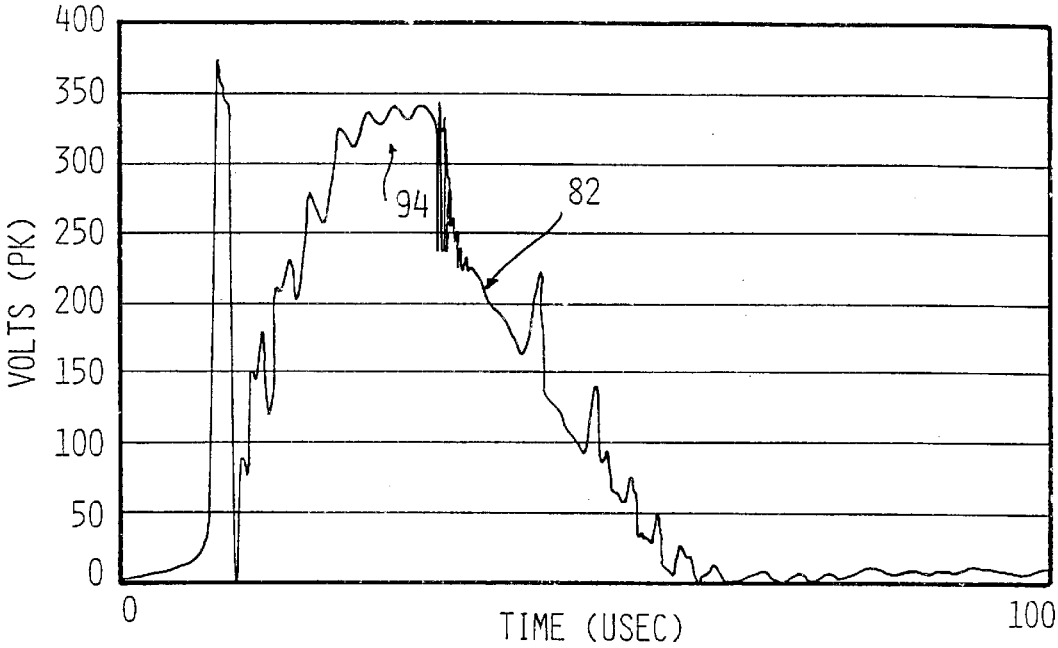
FIG. 3G is a graph illustrating a reflected energy signal produced by an electrically open spark plug.
Figure 3H:
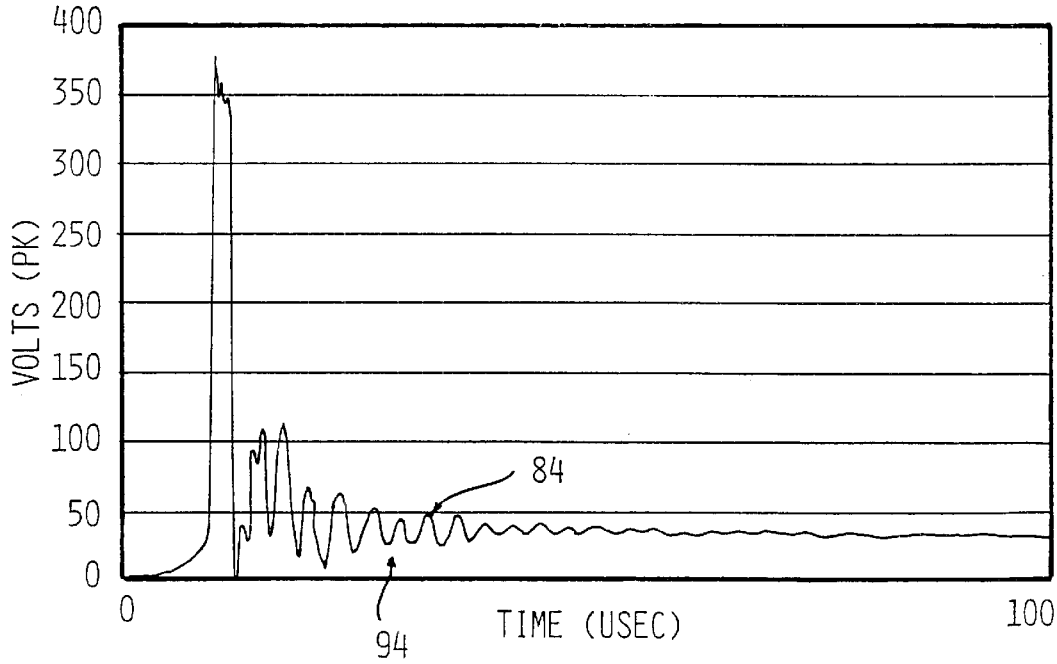
FIG. 3H is a graph illustrating a reflected energy signal produced by an ignition coil connected to a misrouted supply voltage wire.

FIG. 3A is a graph illustrating a reflected energy signal produced by a properly wired, non-defective "coil on plug" assembly generally indicated by 70. FIG. 3B is a graph illustrating a reflected energy signal produced by an electrically open ignition coil generally indicated by 72. FIG. 3C is a graph illustrating a reflected energy signal produced by an insulation boot assembly having an electrically open contact spring generally indicated by 74. FIG. 3D is a graph illustrating a reflected energy signal produced by a spark plug having a cracked insulator generally indicated by 76. FIG. 3E is a graph illustrating a reflected energy signal produced by a spark plug having an electrically shorted pair of electrodes generally indicated by 78. FIG. 3F is a graph illustrating a reflected energy signal produced by a spark plug having an electrode gap approximately equal to or less than 0.050 inches generally indicated by 80. FIG. 3G is a graph illustrating a reflected energy signal produced by an electrically open spark plug generally indicated by 82. FIG. 3H is a graph illustrating a reflected energy signal produced by an ignition coil connected to a misrouted supply voltage wire generally indicated by 84.

In a preferred embodiment, the power supply 54 includes an ignition system circuit 60 for supplying power to each ignition coil 10 in the engine 52 in a predetermined cycle. Typically, the predetermined cycle is set to replicate the spark plug timing and firing sequence specifically designed for the engine to be tested.

The capture circuit 56 includes a signal isolation and conditioning circuit 62 and a digital scope board 64. The signal isolation and conditioning circuit 62 performs several functions. During the test procedure, the signal circuit 62 captures an analog voltage signal reflected from the first winding 16 of one of the ignition coils 10 and identifies from which specific ignition coil 10 the signal was reflected. The signal circuit 62 conditions the captured analog voltage signal by transforming the captured signal from a 0–350 volt peak to peak signal to a 0–10 volt peak-to-peak signal. After the captured signal is conditioned, the signal circuit 62 transmits the conditioned 0–10 volt signal to the digital scope board 64. As an additional feature, the signal circuit 62 isolates the initial 0–350 volt signal from the digital scope board 64 and, thereby, provides a protection against a short to ground condition. A device which meets the functional requirements of the signal isolation and conditioning circuit 62 as described above is manufactured by Freese Enterprises Incorporated, located in Plymouth, Mich., identified as "FEI Signal Isolation and Commutation MODEL".

The digital scope board 64 receives the conditioned analog voltage signal from the signal circuit 62, converts the analog signal to a digital voltage waveform signal, and transmits the digital waveform signal to the comparator circuit 58. To receive or capture the entire analog voltage signal from the signal circuit 62, the digital scope board 64 samples the analog voltage signal at a sampling rate of approximately 10 Ms/s (million samples/second) or faster. A device which meets the functional requirements of the digital scope board 64 as described above is manufactured by PC Instruments, located in Akron, Ohio, identified as "443 Scopeboard".

The comparator circuit 58 includes a central processor 66 for storing the predetermined signals (see FIGS. 3A–3H) representing the various types of defects described above. The central processor 66 compares preselected, indicative portions of each predetermined "defective" signal to corresponding portions of the digital waveform signal to establish a match and, thereby, detects a specific defect. When a defect is detected, the central processor 66 generates an output identifying which specific component (i.e., the ignition coil 10, the insulation boot assembly 12, the spark plug 14, or the supply voltage wire 59) was determined to be defective and what type of defect (e.g., cracked insulator, electrically shorted electrodes, etc.) was detected. The output may be displayed through one of several means, including a display screen. For additional diagnostic purposes, the digital waveform signal may also be displayed on the screen.

The preselected, indicative portion of each predetermined "defective" signal (see FIGS. 3A–3H) varies by defect. For example, the preselected, indicative portion of the electrically open ignition coil signal 72 is the peak voltage of the ignition voltage portion generally indicated by 90 in FIGS. 3A and 3B. Thus, to test for an electrically open ignition coil, the peak voltage of the ignition voltage portion in the digital waveform signal is compared to the peak voltage of the ignition voltage portion 90 in the electrically open ignition coil signal 72. More specifically, if the peak voltage of the ignition voltage portion in the digital waveform signal is less than a minimum peak voltage level, as selected from the properly wired, non-defective "coil on plug" assembly signal 70, then the tested "coil on plug" assembly is determined to have an electrically open ignition coil. The typical peak voltage of the ignition voltage portion may vary by engine type.

The preselected, indicative portion of the electrically shorted spark plug signal 78 is the duration of the ignition voltage portion generally indicated by 92 in FIGS. 3A and 3E. Thus, to test for a pair of electrically shorted electrodes, the duration of the ignition voltage portion in the digital waveform signal is compared to the duration of the ignition voltage portion 92 of the electrically shorted spark plug signal 78. More specifically, if the duration of the ignition voltage portion of the digital waveform signal is less than a minimum amount of time, as selected from the properly wired, non-defective "coil on plug" assembly signal 70, then the tested "coil on plug" assembly is determined to have an electrically shorted spark plug. The typical duration of the ignition voltage may vary by engine type.

The preselected, indicative portion of the remaining five predetermined "defective" signals (i.e. the electrically open contact spring signal 74, the cracked spark plug insulator signal 76, the insufficiently gaped spark plug signal 80, the electrically open spark plug signal 82, and the misrouted supply voltage wire signal 84) is a specific area underneath each "defective" signal generally indicated by 94 in FIGS. 3A, 3C–3D, and 3F–3H. Each specific area is limited between a first time limit and a second time limit which vary by defect. Accordingly, the limited area underneath each "defective" signal is compared to the corresponding area underneath the digital waveform signal. The limited area underneath a specific signal is determined by integrating the respective signal from the first time limit to the second time limit. If the limited area underneath a specific "defective" signal matches the corresponding area underneath the digital waveform signal, then the tested "coil on plug" assembly is determined to have that specific type of defect. For example, if the limited area underneath the missing spark plug signal 82 matches the corresponding area underneath the digital waveform signal, then the tested "coil on plug" assembly is determined to have a missing spark plug. The first and second time limits for each defect may vary by engine type.

The apparatus 50 is programmed to capture a reflected energy signal from each "coil on plug" assembly 15 during at least one complete engine cycle and then test each "coil on plug" assembly 15 for the various types of defects in a predetermined order.

The present invention also provides a method for testing an ignition coil connected to a spark plug. The method includes the steps of: supplying power to the ignition coil to generate a spark across the spark plug; capturing an energy signal reflected from the ignition coil in response to the spark generation; and comparing the captured energy signal to a predetermined signal. Preferably, the method further includes the step of generating an output in response to a match between the captured energy signal and the predetermined signal to indicate a defective ignition coil or a defective spark plug.

The predetermined signal may be selected from one of a distinct group of reflected energy signals that indicate a defective ignition coil, a defective insulation boot assembly, a defective spark plug, or a misrouted supply voltage wire. Specifically, the predetermined signal may be selected to identify the following defects: an electrically open ignition coil; an insulation boot assembly having an electrically open contact spring; a spark plug having a cracked insulator; a spark plug having an electrically shorted pair of electrodes; a spark plug having an electrode gap approximately equal to or less than 0.050 inches; an electrically open spark plug; and an ignition coil connected to a misrouted supply voltage wire. Alternatively, the predetermined signal may be selected to represent a reflected energy signal produced by a properly wired, non-defective "coil on plug" assembly.

Although the apparatus and method are suited primarily for testing an ignition coil and a spark plug connected in a "coil on plug" design, one of ordinary skill in the art will recognize that the present invention may also be used to test for defects in an electrical spark-ignition system which includes a single ignition coil wired to two or more spark plugs. One of ordinary skill in the art will further recognize that the present invention is capable of detecting defects in an insulation boot assembly connected between an ignition coil and a spark plug and is capable of detecting a misrouted supply voltage wire connected between a power supply and an ignition coil.

To determine the reflected energy signal of a defective "coil on plug" assembly (see graphs in FIGS. 3B–3H), an engine including a "coil on plug" assembly having a single known defective component was cold motored or rotated and the reflected energy generated by the spark plug generation was measured on the primary side of the ignition coil. All data was collected with the coil and plug being fired for the first time as would be the case in the normal assembly process. With such data, the apparatus of the present invention can compare an actual reflected energy signal with the "defective" reflected energy signals to detect secondary ignition assembly defects.

The present invention provides an apparatus and method capable of testing a "coil on plug" assembly, and the respective supply voltage wiring, for various types of defects. Further, the present invention is also capable of disclosing which specific type of defect was detected.

What is claimed is:

1. An apparatus for testing at least one ignition coil and at least one spark plug in a spark-ignition engine where said engine has one of a single ignition coil with a plurality of connected spark plugs and a plurality of ignition coils with a single spark plug per coil, the apparatus comprising:

a power supply for supplying power to each ignition coil to generate a spark across each associated spark plug;

at least one capture circuit for capturing an energy signal reflected from each ignition coil in response to said spark generation, each capture circuit positioned between the power supply and each ignition coil for a particular engine to be tested; and a comparator circuit for comparing said captured energy signal to a predetermined signal.

2. The apparatus as set forth in claim 1 wherein the ignition coil includes a first winding in electrical communication with said power supply and a second winding in electrical communication with the spark plug and wherein said energy signal is reflected from the first winding of the ignition coil in response to said spark generation.

3. The apparatus as set forth in claim 1 wherein said comparator circuit generates an output in response to a match between said captured energy signal and said predetermined signal.

4. The apparatus as set forth in claim 1 wherein said reflected energy signal is a voltage waveform signal.

5. The apparatus as set forth in claim 1 wherein said capture circuit includes a signal isolation and conditioning circuit and a digital scope circuit.

6. The apparatus as set forth in claim 1 wherein said comparator circuit includes a central processor.

7. The apparatus as set forth in claim 1 wherein the ignition coil includes a first winding in electrical communication with said power supply and a second winding in electrical communication with the spark plug and wherein said reflected energy signal is a voltage waveform signal reflected from the first winding of the ignition coil in response to said spark generation.

8. The apparatus as set forth in claim 1 wherein said predetermined signal represents a reflected energy signal produced by an ignition coil and a spark plug having no defects.

9. The apparatus as set forth in claim 1 wherein said predetermined signal represents a reflected energy signal produced by one of a defective ignition coil and a defective spark plug.

10. The apparatus as set forth in claim 1 wherein the spark plug includes an insulator and wherein said predetermined signal represents a reflected energy signal produced by a spark plug having a cracked insulator.

11. The apparatus as set forth in claim 1 wherein the spark plug includes a pair of spaced electrodes and wherein said predetermined signal represents a reflected energy signal produced by a spark plug having an electrode spacing approximately equal to or less than 0.050 inches.

12. The apparatus as set forth in claim 1 wherein the spark plug includes a pair of spaced electrodes and wherein said predetermined signal represents a reflected energy signal produced by a spark plug having an electrically shorted pair of electrodes.

13. The apparatus as set forth in claim 1 wherein said predetermined signal represents a reflected energy signal produced by an electrically open spark plug.

14. The apparatus as set forth in claim 1 wherein the predetermined signal represents a reflected energy signal produced by an electrically open ignition coil.

15. An apparatus for testing an ignition coil connected to a spark plug, comprising:

a power supply for supplying power to the ignition coil to generate a spark across the spark plug;

a capture circuit for capturing an energy signal reflected from the ignition coil in response to said spark generation; and a comparator circuit for comparing said captured energy signal to a predetermined signal, wherein an output of the comparator circuit identifies one of a spark plug having a cracked insulator, a spark plug having an electrode spacing approximately equal to or less than 0.050 inches, a spark plug having an electrically shorted pair of electrodes, an electrically open spark plug, and an electrically open ignition coil.

16. An apparatus for testing an ignition coil connected to a spark plug wherein the ignition coil and the spark plug are installed in an engine having a separate ignition coil and spark plug for each engine cylinder, the apparatus comprising:

a power supply for supplying power to the ignition coil to generate a spark across the spark plug;

a capture circuit for capturing an energy signal reflected from the ignition coil in response to said spark generation; and a comparator circuit for comparing said captured energy signal to a predetermined signal; and wherein the engine includes a plurality of cylinders each having a separate coil and spark plug and wherein said power supply includes an ignition system circuit for supplying power to each ignition coil in a predetermined cycle and wherein a separate supply voltage wire is routed between said power supply and each ignition coil and wherein said predetermined signal represents a reflected energy signal produced by an ignition coil connected to a power supply with a misrouted supply voltage wire.

17. An apparatus for testing an ignition coil connected to a spark plug wherein an insulation boot assembly including a contact spring is connected between the ignition coil and the spark plug, the apparatus comprising:

a power supply for supplying power to the ignition coil to generate a spark across the spark plug;

a capture circuit for capturing an energy signal reflected from the ignition coil in response to said spark generation; and a comparator circuit for comparing said captured energy signal to a predetermined signal, said predetermined signal representing a reflected energy signal produced by an ignition coil connected to a spark plug with an insulation boot assembly having an electrically open contact spring.

18. An apparatus for testing a set of ignition coils and spark plugs installed in a spark-ignition engine, each ignition coil having first and second windings, the second winding in electrical communication with each associated spark plug, the apparatus comprising:

a power supply connectable to the first winding of each ignition coil for supplying power in a predetermined cycle to the first winding of each ignition coil to generate a spark across each spark plug;

a signal isolation and conditioning circuit for capturing and conditioning each analog voltage waveform signal reflected from only the first winding of each ignition coil in response to each spark generation;

a digital scope circuit for digitizing each of said captured analog voltage waveform signals; and a central processor for comparing each of said digital signals to a plurality of predetermined signals to detect one of a defective ignition coil and a defective spark plug.

19. A method for testing an ignition coil connected to a spark plug, the ignition coil having first and second windings, the second winding in electrical communication with the spark plug defining a secondary side circuit, the method comprising the steps of:

supplying power to the first winding of ignition coil defining a primary side circuit to generate a spark across the spark plug;

capturing an energy signal reflected from only the first winding of the ignition coil in response to the spark generation; and comparing the captured energy signal to a predetermined signal to detect a defect in the secondary side circuit.

20. The method as set forth in claim 19 further including the step of generating an output in response to a match between the captured energy signal and the predetermined signal.

21. The method as set forth in claim 19 wherein the step of comparing the captured energy signal to a predetermined signal includes the step of comparing the captured energy signal to a predetermined signal representing a reflected energy signal produced by an ignition coil and a spark plug having no defects.

22. The method as set forth in claim 19 wherein the step of comparing the captured energy signal to a predetermined signal includes the step of comparing the captured energy signal to a predetermined signal representing a reflected energy signal produced by one of a defective ignition coil and a defective spark plug.

23. The method as set forth in claim 19 wherein the spark plug includes an insulator and wherein the step of comparing the captured energy signal to a predetermined signal includes the step of comparing the captured energy signal to a predetermined signal representing a reflected energy signal produced by a spark plug having a cracked insulator.

24. The method as set forth in claim 19 wherein the spark plug includes a pair of spaced electrodes and wherein the step of comparing the captured energy signal to a predetermined signal includes the step of comparing the captured energy signal to a predetermined signal representing a reflected energy signal produced by a spark plug having an electrode spacing approximately equal to or less than 0.050 inches.

25. The method as set forth in claim 19 wherein the spark plug includes a pair of spaced electrodes and wherein the step of comparing the captured energy signal to a predetermined signal includes the step of comparing the captured energy signal to a predetermined signal representing a reflected energy signal produced by a spark plug having an electrically shorted pair of electrodes.

26. The method as set forth in claim 19 wherein the step of comparing the captured energy signal to a predetermined signal includes the step of comparing the captured energy signal to a predetermined signal representing a reflected energy signal produced by an electrically open spark plug.

27. The method as set forth in claim 19 wherein the step of comparing the captured energy signal to a predetermined signal includes the step of comparing the captured energy signal to a predetermined signal representing a reflected energy signal produced by an electrically open ignition coil.

28. A method for testing an ignition coil connected to a spark plug, comprising the steps of:

supplying power to the ignition coil to generate a spark across the spark plug, wherein an insulation boot assembly including a contact spring is connected between the ignition coil and the spark plug;

capturing an energy signal reflected from the ignition coil in response to the spark generation; and comparing the captured energy signal to a predetermined signal representing a reflected energy signal produced by an ignition coil connected to a spark plug with an insulation boot assembly having an electrically open contact spring.

29. method for testing an ignition coil connected to a spark plug wherein the ignition coil and the spark plug are installed in an engine having a plurality of cylinders, each cylinder having a separate ignition coil and spark plug, comprising the steps of:

supplying power to the ignition coil to generate a spark across the spark plug, wherein a separate supply voltage wire is routed between a power supply and the separate ignition coil of each cylinder;

capturing an energy signal reflected from the ignition coil in response to the spark generation; and comparing the captured energy signal to a predetermined signal representing a reflected energy signal produced by an ignition coil connected to a power supply with a misrouted supply voltage wire.

30. In an engine assembly line, an apparatus for cold motor testing an engine having at least one ignition coil and at least one spark plug, the improvement comprising:

a power supply for supplying power to the ignition coil to generate a spark across the spark plug;

at least one capture circuit positioned between the power supply and each ignition coil for capturing an energy signal reflected from the ignition coil in response to said spark generation; and a comparator circuit for comparing said captured energy signal to a predetermined signal.

31. An apparatus for testing an ignition coil connected to a spark plug, the ignition coil having first and second windings, the second winding in electrical communication with the spark plug defining a secondary side circuit, the apparatus comprising:

a power supply connectable to the first winding of the ignition coil defining a primary side circuit for supplying power to the first winding to generate a spark across the spark plug;

a capture circuit for capturing an energy signal reflected from the first winding of the ignition coil in response to said spark generation; and a comparator circuit for comparing said captured energy signal to a predetermined signal and generating an output in response to a match between said captured energy signal and said predetermined signal indicating a defect in the secondary side circuit.

32. In an apparatus for testing an ignition coil connected to a spark plug, the improvement comprising:

a power supply for supplying power to the ignition coil to generate a spark across the spark plug wherein the ignition coil and the spark are installed in an engine having a separate ignition coil and spark plug for each engine cylinder;

a capture circuit for capturing an energy signal reflected from the ignition coil in response to said spark generation; and a comparator circuit for comparing said captured energy signal to a predetermined signal.

* * * * *